United States Patent [19]

Perrin et al.

[11] Patent Number: 4,518,499

[45] Date of Patent: May 21, 1985

[54] APPARATUS FOR FRACTIONATING SOLID PARTICLES SUSPENDED IN A LIQUID

[75] Inventors: Bernard Perrin, Grenoble; Bernard Bianchin, Seyssinet; Georges Sauret, Grenoble, all of France

[73] Assignee: Centre Technique de L'Industrie des Papiers, Cartons et Celluloses, Grenoble, France

[21] Appl. No.: 607,140

[22] Filed: May 4, 1984

Related U.S. Application Data

[62] Division of Ser. No. 284,823, Jul. 20, 1981, Pat. No. 4,477,359.

[30] Foreign Application Priority Data

Jul. 25, 1980 [FR] France ..... 80 16756

[51] Int. Cl.[3] ..... B01D 35/20

[52] U.S. Cl. ..... 210/332; 210/340; 210/413; 210/415

[58] Field of Search ..... 210/748, 785, 928, 413, 210/415, 340, 327, 400, 499, 332, 334

[56] References Cited

U.S. PATENT DOCUMENTS

| | | | |
|---|---|---|---|
| 1,505,836 | 8/1924 | White | 92/93 |
| 2,463,814 | 3/1949 | Skinner | 92/29 |
| 3,363,759 | 1/1968 | Clarke-Pounder | 210/415 X |
| 3,491,021 | 1/1970 | Huntington | 210/748 X |
| 3,672,506 | 6/1972 | Syrjanen | 210/415 X |
| 3,766,059 | 10/1973 | Sasaki | 210/332 X |
| 3,833,468 | 9/1974 | Boniface | 162/264 |
| 4,233,159 | 11/1980 | Senda et al. | 210/413 X |
| 4,312,756 | 1/1982 | Hug | 210/334 X |
| 4,337,158 | 6/1982 | Bodine | 210/785 |
| 4,396,502 | 8/1983 | Justis | 210/415 X |

FOREIGN PATENT DOCUMENTS

| | | |
|---|---|---|
| 366127 | 12/1972 | Fed. Rep. of Germany . |
| 2924794 | 3/1980 | Fed. Rep. of Germany . |
| 1145263 | 10/1957 | France . |
| 2232345 | 1/1975 | France . |
| 485553 | 5/1938 | United Kingdom . |

OTHER PUBLICATIONS

French Republic Search Report.

*Primary Examiner*—Thomas Wyse
*Attorney, Agent, or Firm*—Parkhurst & Oliff

[57] ABSTRACT

A process for fractionating a suspension of solid particles in a liquid, of the type wherein said suspension is made to pass through a filtering screen, characterized in that said suspension is directed in a direction parallel to the longitudinal axis of an elastically deforming, flexible, perforated sleeve forming a filtering screen, and in that a sequence of high and low pressures is continuously created within this sleeve and travels at least predominantly opposite the direction of the suspension flow. The invention also applies to equipment.

8 Claims, 11 Drawing Figures

APPARATUS FOR FRACTIONATING SOLID PARTICLES SUSPENDED IN A LIQUID

This is a division of application Ser. No. 284,823, filed July 20, 1981, now U.S. Pat. No. 4,477,359.

The invention relates to a process and to equipment for fractionating solid particles suspended in a liquid; more particularly, but non-specifically, the invention concerns a process and equipment for treating paper-industry fiber suspensions.

In what follows, the invention will be described in further detail in relation to its preferred paper industry application.

It is well known in the paper industry to try to recover fibers in suspension dumped down drains. However, the low concentration of these suspensions, i.e., on the order of 0.2 to 1 g of solids per liter, requires treatment of very large amounts of water.

The processes known to date that provide for economical treatment of very large amounts of low-concentration suspensions do not permit the simultaneous fractioning of the solid phase contained in the effluents in order to recover the valuable parts.

For instance, the effluents may be decanted or "floated" before being discarded, whereby the water can be purified, but this does not allow for selectively recovering the fibers from the thickened suspension which then is entirely discarded. Therefore, substantial amounts of raw materials are lost, and these raw materials are increasing in price.

U.S. Pat. No. 3,833,468 proposes to purify suspensions using an inclined screen consisting of a curved and rigid grille. The invention is suited to retain coarse impurities such as gravel and sticks; however, it is inefficient when used to selectively recover fibers because, in time, the grille clogs by said fibers which unfortunately tend to set themselves perpendicularly to the filtering grille. There have also been attempts to use sifting panels provided with flexible filtering cloths. However, these filters usually clog too rapidly, even in spite of the additional anti-clogging effects caused by vibrations or water sprayed from banks.

British Pat. No. 485,553 describes equipment for filtering paper pulps, which consists of a straight series of screens with slanted rigid slits which are crossed by the suspension to be purified and wherein the filtrate from each screen is collected in separate chambers subjected to pressure pulses from a diaphragm. Thus the unclogging is achieved by a to-and-fro motion of the filtrate through the screen, whereby on one hand there is a risk of reintroducing part of the fine-particulate substances and water into the suspension to be treated, and on the other hand there is insufficiency in breaking up the fiber layer kept by the screen.

German Pat. No. 366,127 comprises a slitted horizontal screen associated with fins arranged in the collection chamber of the filtrate and rotating in the direction of flow of the suspension to be purified. Besides the drawbacks cited above, this equipment, which is suited for extracting fiber agglomerates, does not economically allow for fractionating fibers which are more individualized due to its low flow rates and substantial fiber losses, hence it is unsuited to treat very dilute suspensions.

French Pat. No. 1,145,263 describes a dripping method for very fine grain products with a high water content, wherein the filtering cloth is subjected to mechanical vibrations. These cloth vibrations permit the release of the liquid particles, but unfortunately are insufficient to break up the cake formed—which moreover is not the object. Accordingly, this technique does not allow an efficient use for fractionating a fiber suspension.

In other words, the purifying equipment known and used to date are unsuited because either they clog in the course of the treatment, or because they do not permit selective separation of the fiber fraction.

The object of the invention is a process and equipment for the selective separation of a fraction of the solid particles in a liquid suspension, in rapid and economic manner, even at high flow rates and low concentrations.

The invention also relates to a process and equipment which are especially adapted to treating paper industry fiber suspensions, and in particular, at solid concentrations between 0.2 and 2 g per liter.

More specifically, the invention is adapted to treat paper industry effluents upstream of the purification station, the selective recovery of the valuable fibers being sought in such a treatment.

This process for the separation of the solid particles in a liquid suspension and of the type wherein the said suspension is made to pass through a sifting screen is characterized in that said suspension is directed parallel to the longitudinal axis of a flexible, elastically deforming perforated sleeve which represents the filtering screen, and in that a succession of high and low pressures are continuously generated within this sleeve, moving in counterflow with respect to the flow direction of the suspension.

Depending upon the particular embodiments:

the sleeve is made of a textile material, for instance an open-work woven cloth of which the mesh preferably is rectangular, the small rectangle dimension being in the direction of the flow in order to favor passage of the fine-particulate matter and retention of the fibers;

the sequence of high and low pressures is generated by deforming the sleeve cross-section and by propagating this deformation along a generatrix of said sleeve in a direction opposite the suspension flow;

this sequence of high and low pressures is generated by displacing a movable body in counterflow to the direction of flow of the suspension into the said sleeve.

The invention also relates to equipment for separating the solid particles in a liquid suspension. Equipment of this type comprises an feed conduit for the liquid suspension to be treated, a filtering means, a filtrate extracting means and a means for recovering the concentrated solid fraction characterized in that said filtering means consists of:

a fixed, perforated, flexible elastically deforming sleeve of a generally frustrum-of-cone shape connected by its wider end to the feed conduit and by its narrower end to the recovery means;

a means for guiding the flow of suspension to be trated along the longitudinal axis of said sleeve; and a means for generating a sequence of high and low pressures continuously traveling against the flow of said suspension.

Practically, the sleeve is a flexible filtering cloth of which the meshes are, as already stated, advantageously rectangular;

this sleeve can be oriented and inclined, in particular with respect to the means of generating a sequence of high and low pressures in order to enhance the deformation of said sleeve;

the axis of the feed conduit of the suspension to be purified as a rule conincides with the longitudinal sleeve axis;

the means for generating a sequence of high and low pressures within the sleeve consists of a rotating helicoidal rigid coil transversely resting permanently against said sleeve and deforming it, the contact point between said coil and the filtering wall of the sleeve moving in the opposite direction to the suspension flow;

the pitch of the coil is less than the sleeve length; and the means for generating a sequence of high and low pressures consists of a movable body located within said sleeve and evincing a reciprocating motion in the longitudinal direction, said movable body presenting its maximum penetration coefficient when it is moving against the suspension flow and its minimum penetration coefficient when it comes back in the other direction.

An advantageous means for generating a sequence of high and low pressures consists of an endless belt moving in the opposite direction of the suspension flow and comprising rigid bars spaced along said belt, part of these bars resting transversely and in turn on the sleeve and deforming it. These rigid bars may be of varied shapes and cross-sections. Also, they may be mounted idle on their shafts.

As a practical matter, the purifying means may comprise several parallel sleeves and a single means for generating sequential high and low pressures within these sleeves by simultaneous action.

Again, the equipment may moreover comprise auxiliary introduction means within the sleeve for the suspension such as feed conduits, which are directed substantially in the sequence of the suspension flow in order to compensate the progressive drop in speeds due to the decrease in flow rate as the filtrate is being evacuated. This furthermore allows for achieving an additional purification of the fiber fraction which is to be recovered.

The functioning of the equipment also may be explained as follows:

When a fiber suspension (2) is fed into a flexible filtering sleeve (1) (FIG. 1), for instance, made of a woven cloth, in the longitudinal direction of said sleeve (1)—in the direction indicated by the arrow A—the elementary fibers (3) of said suspension preferably line up in this direction near the wall (1).

When a rigid member (4) is applied to this flexible sleeve (1) (FIG. 2), where said member moves in counterflow in the sense indicated by the arrow B, this rigid member first induces a deformation in the sleeve (1). At the same time and upstream of this member (4) (zone indicated by the reference 5), the suspension (2) is being filtered and the fibers form a fiber layer (6) on the wall of the sleeve. If the fibers were allowed to go on depositing continuously on this layer (6), then this layer in turn would act as the filtering medium, thereby opposing the passage of the liquid and of the fine particles through the sleeve wall.

However, when the member (4) moving in counterflow direction meets this layer (6), this layer will crumble and detach from the wall in the zone (7). A low pressure (8) is formed thereupon downstream of the member (4) (FIG. 3) between the detached layer (7) and the cloth (1), detaching in turn the residue (7) of the layer (6) and returning the fibers into the suspension (9).

This suspension is then accelerated by the eddy created by the displacement of the member (4) along the sleeve (1).

In this manner, a sequence of high and low pressures moving opposite to the flow of the suspension to be treated has been created, the high pressure being applied upstream with respect to the flow, i.e., in zone (5), while the low pressure takes place downstream, i.e., in zone (8).

In other words, the invention concerns a process and particularly efficient fractionating equipment for suspensions with low solid concentrations, resorting to four features:

(1) Using an elastically deforming, flexible perforated sleeve, whereby fibers may be efficiently returned into suspension duroing the application of a sequence of high and low pressures.

(2) Displacing the suspension with respect to the sleeve, whereby fiber movility and their lengthwise orientation in the boundary shear layer and favored.

(3) Deforming the sleeve by applying a sequence of high and low pressures.

(4) The continuous travel of this sequence of high and low pressures, with respect to the sleeve surface, which results in a continuous and uniform unclogging, and with respect to the suspension flow and mainly in the direction opposite to this flow, thereby the amplitude of the pressure pulses is increased and the fibers partly engaged in the sleeve meshes are more likely to return into the suspension.

More specifically, it is the layer about to be formed which is favored to return into suspension. This is so because the return into suspension of the fibers partly engaged in the sleeve meshes is due to the speed of the liquid with respect to the sleeve cloth whereby a boundary layer is created within which the fine-particulate elements may flow through the cloth, whereas the fibers, of which one end is in front of a mesh, as a rule have their other end in a liquid layer more distant from the cloth, the speed of the farther-away layer of liquid relative to the sleeve is much higher than the speed with which the liquid "passes" through the sleeve; in this manner the return of the fibers into the suspension is favored.

It is practically known that when the fiber layer (6) forms at the intake of the sleeve (1), it initially contains not only fibers (valuable substances), but also fine-particulate materials (minerals, fiber fragments and other low-value substances) which are trapped in the structure of said layer when it is forming and therefore no longer can migrate toward the filtering wall.

By deforming the sleeve (1) by means of the translatory motion of the member (4) opposite the suspension flow, the fiber layer (6) is released and detached from the wall, whereby the fine-particulate substances are freed and now can be entrained by the liquid through the filtering cloth.

In a way, unclogging of the filtering cloth and self-rinsing of the fiber layer are achieved simultaneously without introducing additional water in the system.

Thus, the farther along the generatrix of the sleeve (1), the higher the fiber concentration in the fiber layer (6).

Because the flow of the suspension (2) is in the lengthwise sleeve direction near the boundary layer, the fibers (3) are preferentially arrayed parallel to the longitudinal axis of the fiber layer (6) and therefore will not tend to implant themselves into the cloth, whereby the clogging tendency is limited.

On the other hand, the preferential orientation of the fibers in the longitudinal sense permits using coarser meshes, which enhances both an improved selectivity in separation (easier evacuation of the fine particulate substances) and a higher treatment rate (higher filtration rate).

The filtration effect also is favored by displacing the member (4) in contact with the outside wall of the sleeve (1), which thus "wipes" off the trickling drop that would oppose filtration.

Moreover, by its very shape, the sleeve is free from both dead angles and stagnation zones.

The manner in which the invention can be implemented and the ensuing advantages will be better understood in relation to the description below and the illustrative embodiments considered in light of the attached figures, the whole being provided in illustrative and non-restrictive manner.

As already stated, FIGS. 1 through 3 show a summary explanation of the phenomena involved.

FIGS. 4 and 5 schematically show a first equipment for implementing the invention, seen as a cross-section in elevation (FIG. 4) and in longitude (FIG. 5). FIG. (6) is a detail seen in top view.

FIG. 9 shows a longitudinal section of a preferred embodiment of the invention while

Figure 1:
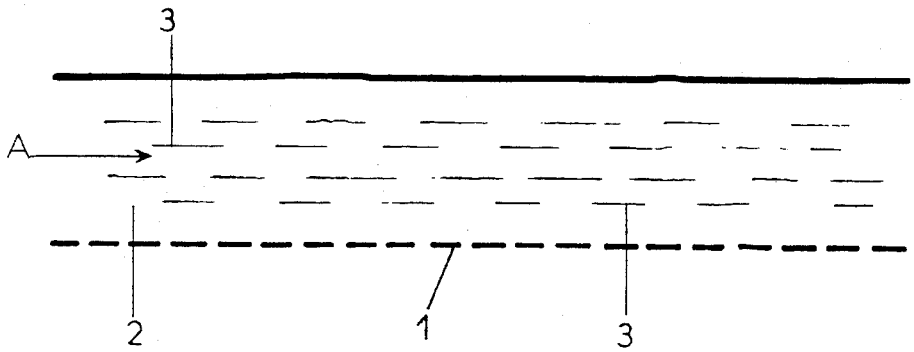
Figure 2:
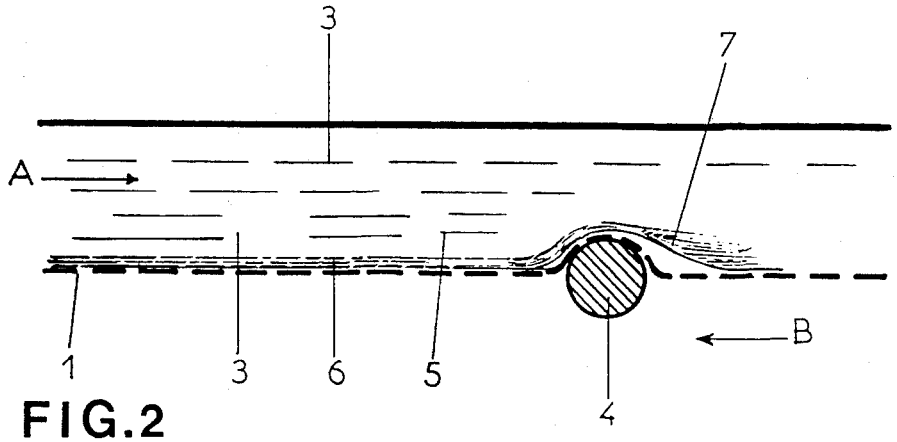
Figure 3:
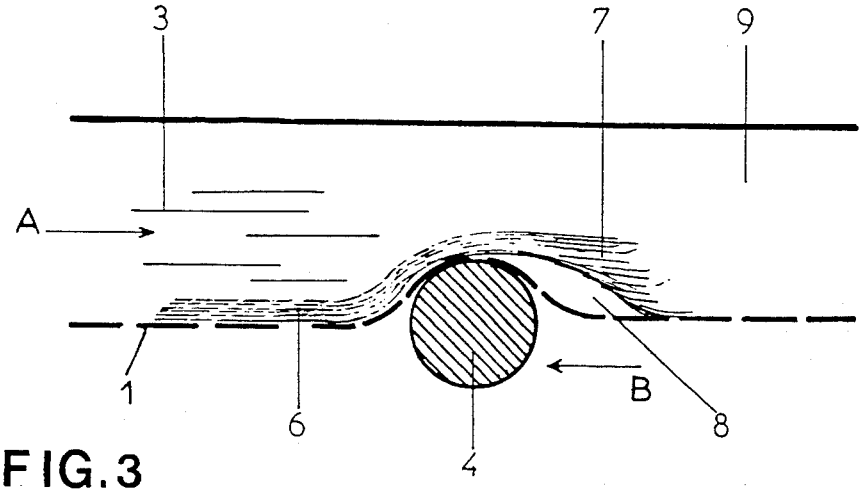
Figure 4:
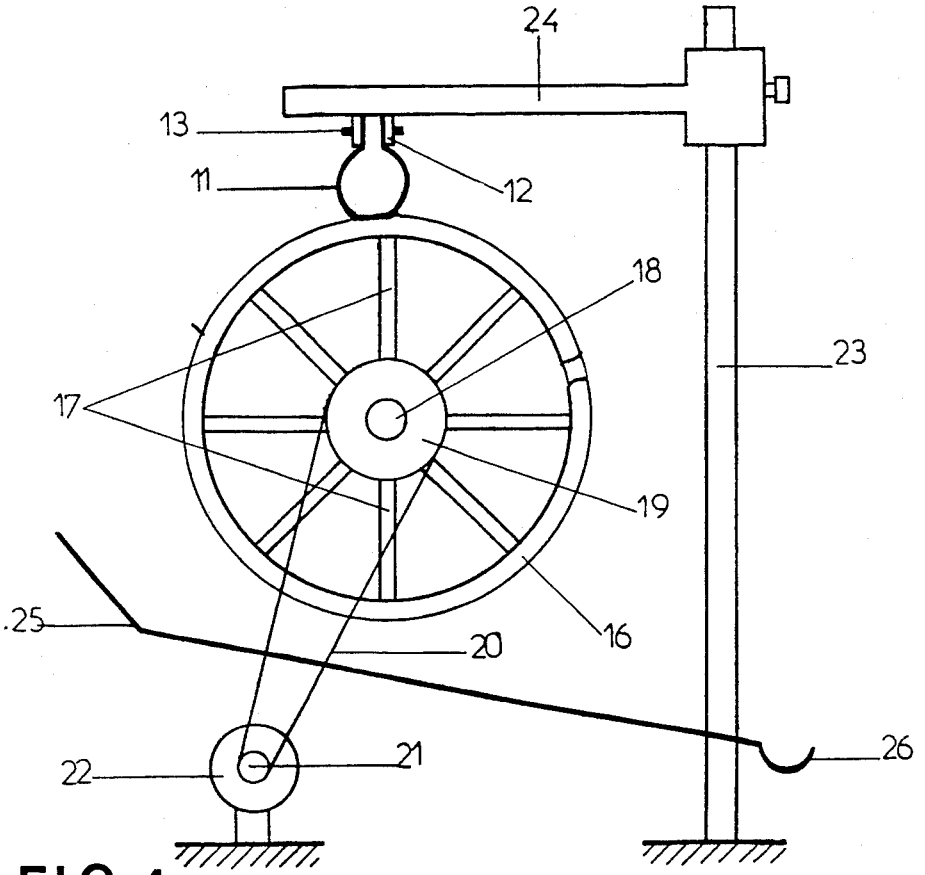
FIGS. 4, 5 and 6 show the first equipment wherein a sequence of high and low pressures is generated by deforming the cross-section of the filtering sleeve from the outside and wherein this deformation is propagated along a sleeve generatrix in the direction opposite to the flow of the suspension.
Figure 5:
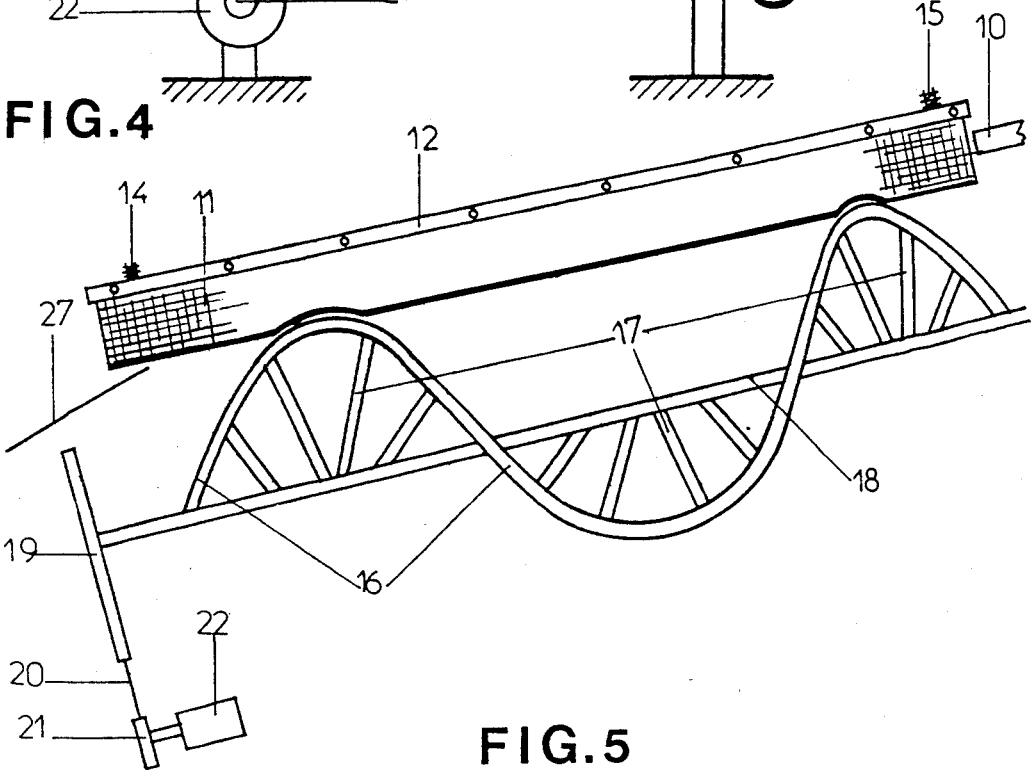
Figure 6:
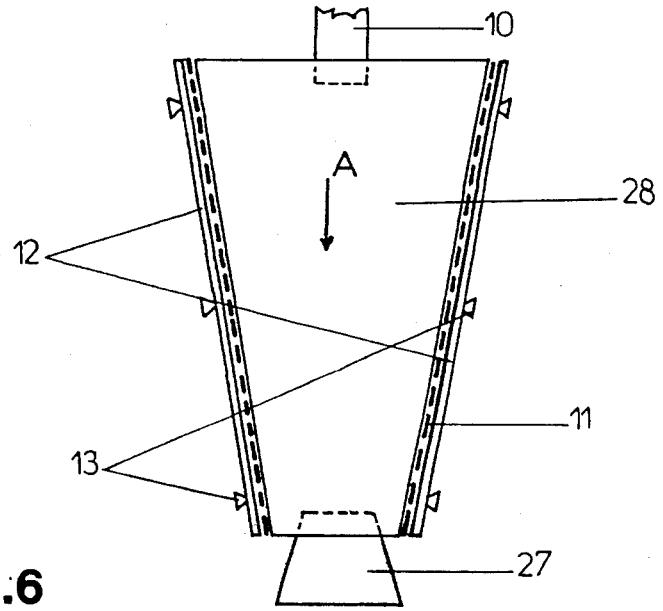

Referring to FIGS. 4 through 6, this equipment comprises:

A feed conduit (10) for the liquid suspension to be treated; a sleeve (11), for instance made of a flexible polyester cloth with a rectangular mesh of conventional size for use in the paper industry, the cloth assuming the overall shape of a cylindrial frustrum of a cone (11) by means of two clamping plates (12) and nuts (13); two adjustable supports (14) and (15) by means of which the inclination of this cloth (11) can be varied; a rigid tube (16) coiled in the shape of a helix and connected by spokes (17) to a longitudinal shaft (18) driven into rotation by a pulley (19), a belt (20), a second pulley (21) and a motor (22), the shaft (18) being substantially parallel to the longitudinal axis of the sleeve (11); an upright post (23) along which moves the sleeve-holder (24), whereby the distance between the sleeve (11) and the coil (16) can be varied, and hence the pressure from this coil (16) on the sleeve (11), and moreover the inclination of this sleeve (11) with respect to this coil (16); a recovery tub (25); gutter (26) to evacuate the filtered water and the fine-particulate substances; and a means (27) for recovering the concentrated fraction at the low end of the sleeve (11) (this may be, for instance, an inclined plane, advantageously of a filtering nature and connected to the recovery gutter).

FIG. 6 is a top view of detail (deformed for better clarity) of the sleeve (11) fixed by nuts (14) on the clamping plates (12) on the outside and resting on the inside on a support (28) which tapers in the flow direction A. Thereby this tapered shape imparts a frustrum-of-cone shape to the sleeve (11) which narrows in the flow direction for the purpose of compensating the progressive loss in speed due to the decrease in flow rate as the filtrate evacuation proceeds.

The overall inclination of this system also favors maintaining the flow rate by using gravity to reduce the load losses.

Figure 7:
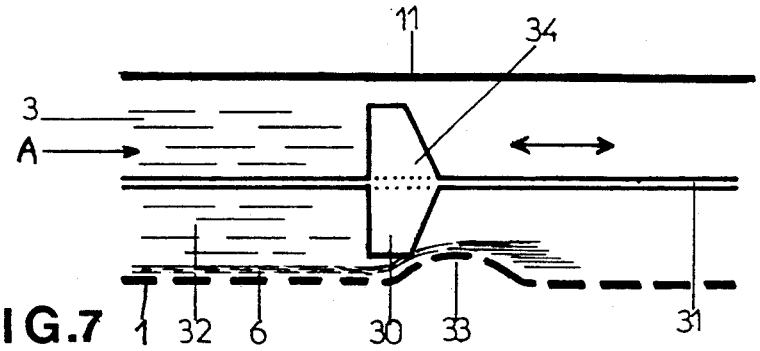
FIGS. 7 and 8 show two other embodiments of the invention.

FIG. 7 shows a variation of the equipment of FIG. 4, wherein the outside coiled helix (16) is replaced by a movable body (30) solidly fixed to a longitudinal shaft (31) parallel to the longitudinal axis of the sleeve (11); this longitudinal shaft (31) is driven by a suitable means into reciprocation and is located inside the sleeve (11). This mobile body (30) must be of greatly varied shapes (plane, ovoidal, etc.) and must be sufficiently away from the sleeve rims so as not to scrape the fiber layer (6) or seriously affect the flow of the suspension.

A pressure favoring filtration is exerted upstream of the movable body (30). Immediately downstream, that is to the rear of the movable body (30), a low pressure is created which tends to deform the flexible sleeve (11) at (33). Thus as before there is a sequence of high and low pressures enhancing the efficiency of the treatment, as shown above.

It is obvious that for a rigid sleeve (11), there would be only a sequence of high and low pressures with no deformation. In a particular embodiment, when the movable body (30) comes back in the downstream direction, that is in the sense of flow of the suspension, the downstream walls (34) of the movable body (30) are deformed in order not to excessively disturb the suspension flow, i.e., to decrease the penetration coefficient. In such an instance the movable body (30) may be designed like an open umbrella when moving upstream.

Moreover, a set of movable bodies (30) suitable spaced apart may be mounted on the longitudinal shaft (31).

Figure 8:
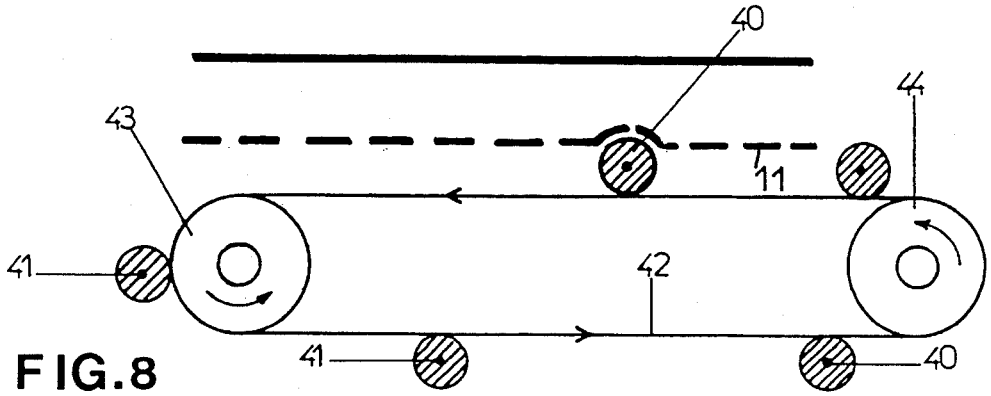

FIG. 8 shows another embodiment with a flexible sleeve (11) and the deformation taking place from the outside. In this case the deformation is implemented by a set of sequential parallel rollers (40) spaced along an endless belt (42) driven into continuous rotation by two synchronized pulleys (43) and (44). These rollers are mounted in idle manner on the shaft (41) in order to decrease friction with the sleeve (11) and hence decrease the wear of this cloth (11) and consumption of energy. In this manner a sequence of high and low pressures is created within the sleeve due to those rollers, where this sequence travels opposite to the flow of the suspension, only part of those rollers rest transversely and in turn against the sleeve they are then deforming.

Figure 9:
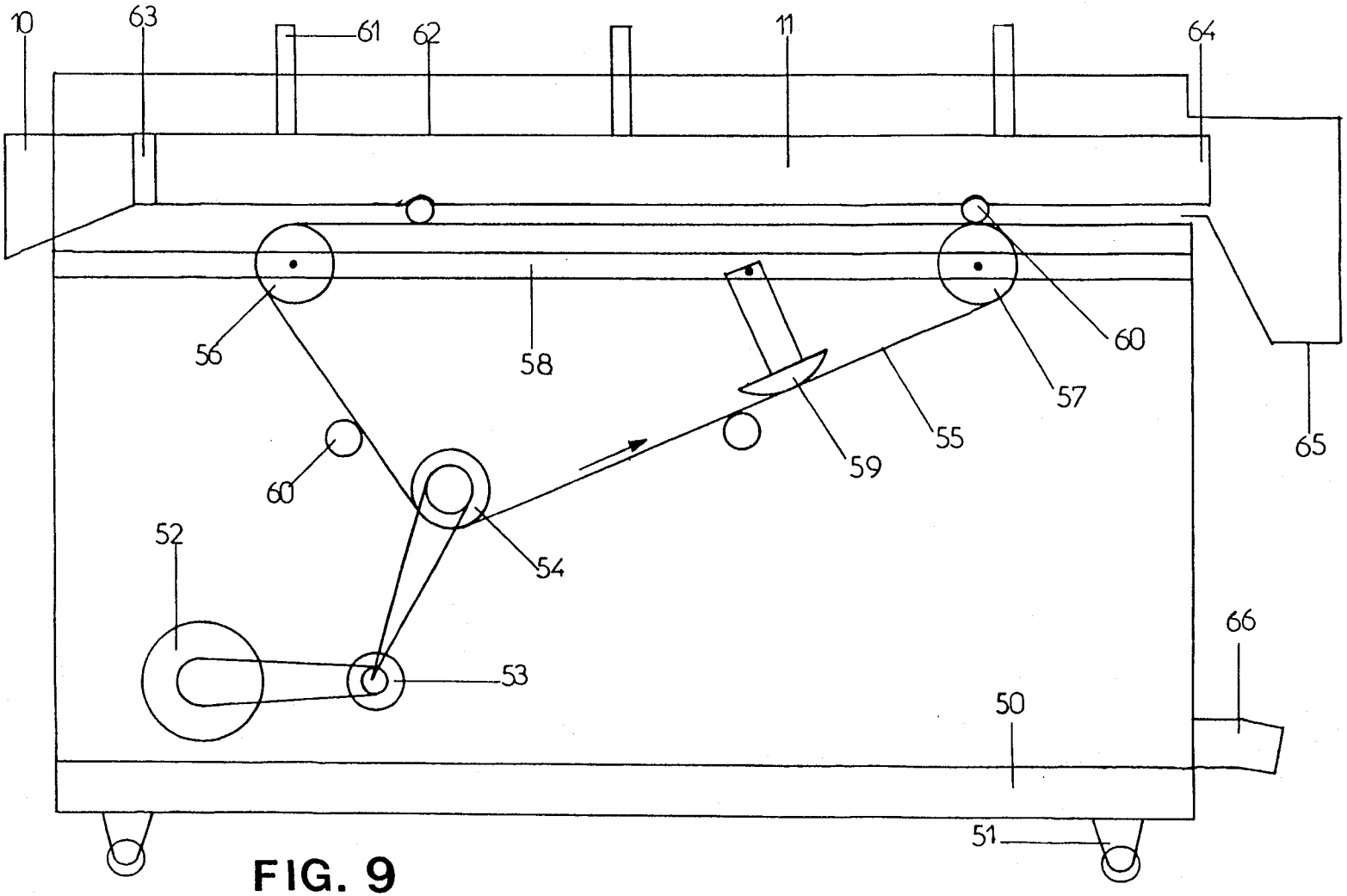
Figure 10:
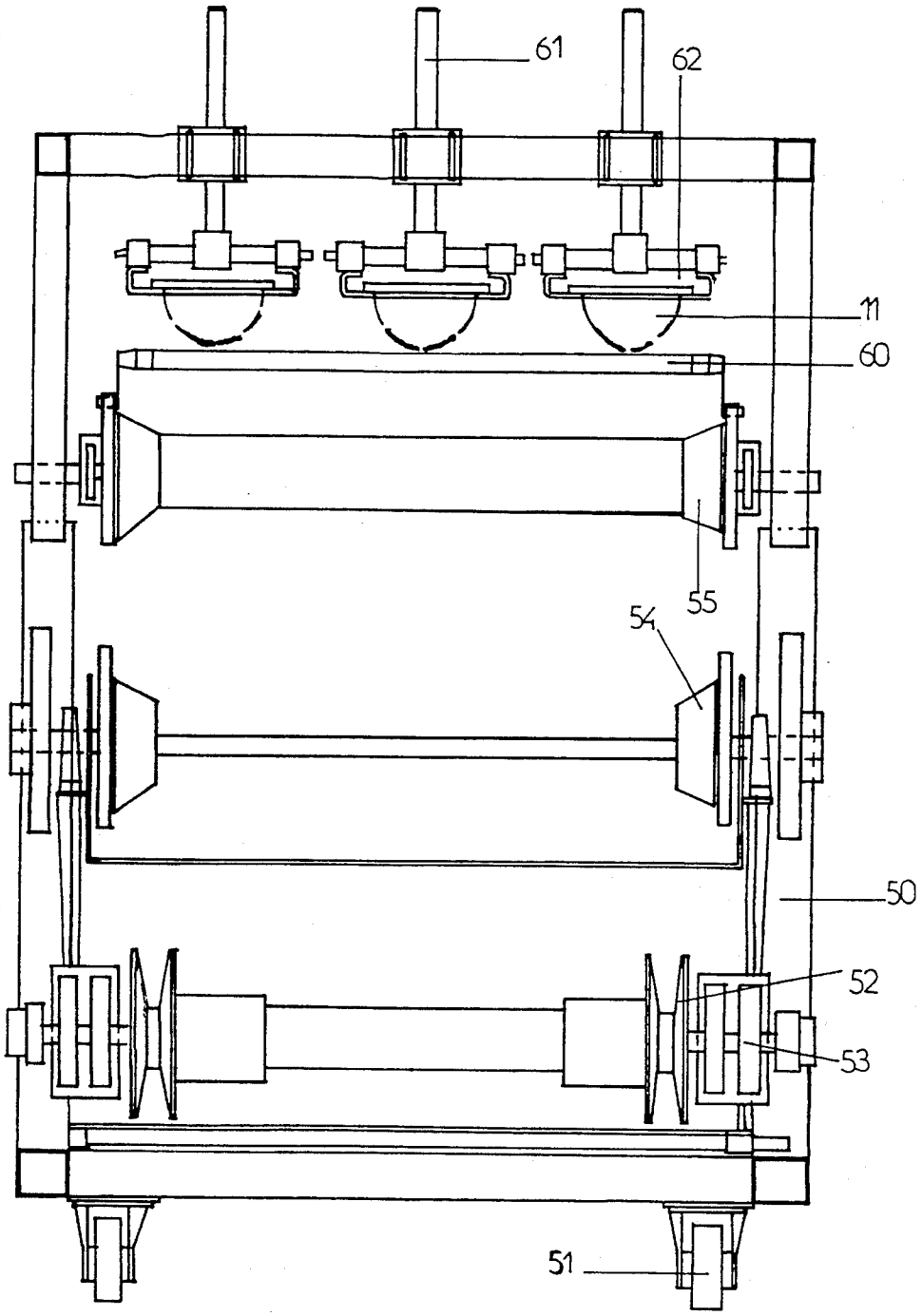
FIG. 10 shows a transverse section.

FIGS. 9 and 10 show a longitudinal and a cross section, respectively, of a preferred embodiment of the invention. This equipment essentially comprises a frame means (50) mounted on casters (51) and seating a motor (52) which by means of a variable transmission (53) drives a pulley (54). This drive pulley (54) drives an endless chain (55) passing over two other guide pulleys (56) and (57) supported by a cross-beam (58). This horizontal cross-beam (58) also comprises a chain-tensioning guide-means (59). The chain (55) bears rigid cylindrical bars (60) which are regularly spaced apart so that there shall always be at least one contact point between one bar (60) and the deforming sleeve (11).

At the top of the frame means (50), adjustable supports (61) keep a plate (62) at a given height and sideways position which, when seen in top view, tapers from left to right in order to impart a generally fustrum-of-cone shape to the sleeve (11). This plate (62) is connected to the flexible perforated sleeve (11) made as before of a paper industry cloth. The upstream end (63) of this cloth (11) at the proper moment will be connected to the feed conduit (10) of the suspension to be purified, whereas its downstream end (64) issues in a box (65) where the concentrated fibers are recovered (similar to 27). (66) denotes a conduit for evacuating the filtrate (similar to the gutter 26).

EXAMPLE 1

Equipment according to FIGS. 4 through 6 is made, with the following characteristics:

the sleeve (11) is made of woven polyester bristle cloth, the bristles being 320 microns in diameter, the meshs of the cloth of the sleeve (11) are 250×600 microns, the length of the sleeve (11) is 100 cm, the diameter of the coil (16) is 100 cm, the pitch of the coil (16) is 80 cm, angular speed of the coil (16) is 200 rpm.

A suspension collected just downstream of a paper making machine is treated in this equipment before being dumped into the river. This suspension essentially comprises long fibers and fine-particulate substances, and is treated under the following conditions:

concentration of solids in the suspension fed to (10)—0.45 g/l, flow rate of the suspension—12.6 $m^3/h$, ash proportion before treatment—17%.

Following the treatment, a filtrate is obtained at (26) with an average concentration in solids (the test values are the mean of 20 measurements) of 0.11 g/l whereas the average concentration of the fiber fraction received at (27) is 7.5 g/l. The fiber yield is about 75%.

EXAMPLE 2

Example 1 is repeated using another suspension with a heavier load of minerals (paper industry sludges containing a high proportion of very short fibers) of the following characteristics:

solids concentration—1.22 g/l, ash proportion—58%,

The following results are obtained (fiber fraction received at 27):

solid concentration—4.1 g/l, ash proportion—16%, fiber yield—28%.

The filtrate collected at (26) shows:

solids concentration—1.0 g/l, ash proportion—62.6%.

EXAMPLE 3

Example 2 is repeated using a sludge with a solids concentration of 1 g/l, an ash proportion of 45% and a dripping index of 75° SR (degrees Schopper-Riegler).

The following results are obtained after treatment:

the materials accepted at (27) have a solids concentrations of 15 g/l, ash proportion of 20%, fiber yield of 70%, and a dripping index of 20° SR, the rejects at (26) have a solids concentrations of 0.7 g/l, an ash proportion of 77%, and a fiber yield of 30%.

EXAMPLE 4

As a control test, the same sludge as in Example 3 is used in a commercial rigid curved grille purifier of the type described in the preamble. The following results are obtained:

accepted materials have a solids concentration of 9.5 g/l, an ash proportion of 7%, and a fiber yield of 42%, rejected materials have a solids concentrations of 0.77 g/l, and an ash proportion of 58%.

EXAMPLE 5

An embodiment as disclosed in FIGS. 9 and 10 is used, which offers the following general characteristics:

3 sleeves (11) in parallel and similar to that of Example 1 with a length of 200 cm, average diameter of these sleeves is 9 cm, taper of plate (62) at the intake, side 63, is 12 cm while at the exhaust, side 64, it is 8 cm, cylindrical bars (60) have a diameter of 3 cm with a spacing of 80 cm, length of chain (50) is 480 cm, translational speed of the bars 60 is 200 m/min.

Using this equipment, the same suspension as in example 1 is treated. The essentially same results are obtained, but with a flow rate of 80 $m^3/hr$.

EXAMPLE 6

Figure 11:
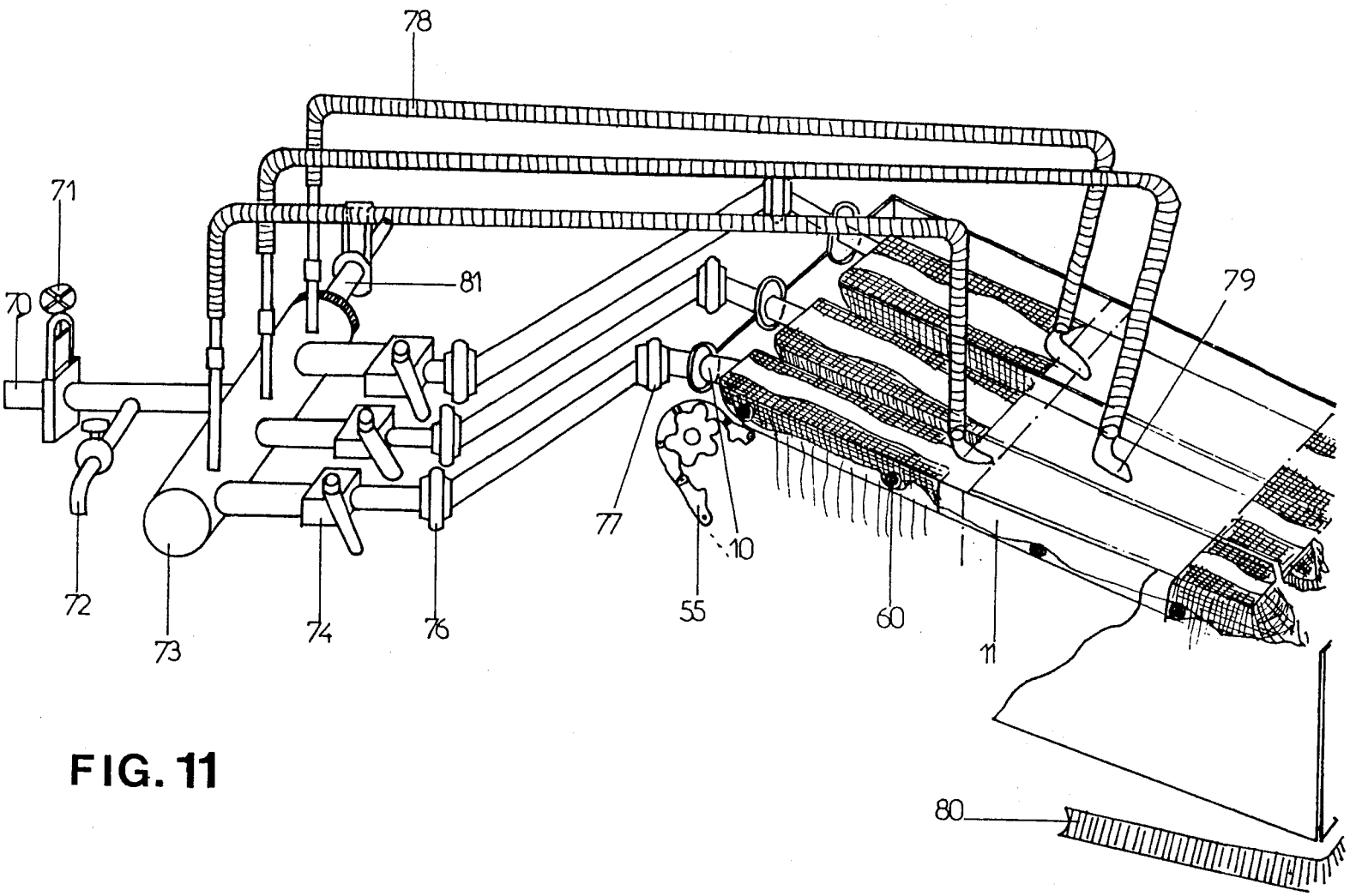
FIG. 11 is a summary schematic view of an improved facility implementing this process.

The equipment shown in FIG. 11 is used, which essentially comprises:

a feed conduit (70) for the suspension to be purified, a valve (71) and a sampling member (72), a distribution box (73) from which depart three separate conduits (74) each provided with a manual valve (75), swivel joints (76) and (77) and connected to the feed conduit (10) which is located just upstream of the sleeve (11); thus there are three parallel filtering sleeves;

a chain (55) with its straight bars (60), three other auxiliary conduits (78) also issue from this box (73) and enter respectively the three sleeves (11) downstream of (10) by means of injectors (79) directed downstream of the sleeve (11); one or more injectors may be placed in the same sleeve (11);

a conduit (80) for sewer evacuation of the filtrate and a bypass (81) connected to the same sewer.

These auxiliary suspension feeds improve the reliability of industrial operation and favor unclogging and purification.

Obviously, in view of the fractionating principle implemented by the invention, it may happen that some coarse impurities are retained in the concentrated fiber fraction. However, this is not a problem since coarse impurities are nearly wholly eliminated upstream of the paper-making maching in a well planned paper making facility. In any case, the elimination of such impurities is quite easy for the concentration achieved.

The invention offers numerous advantages over the techniques of the state of the art applied to-date. Among these are:

the feasibility of treating high flow rates per unit filtration surface of the order of $150M^3/h$ per $m^2$, the low energy consumption, the compactness of the equipment and its low cost, the possibility of placing several sleeves either in parallel or in series associated with a single deforming element, the possibility of achieveing a dripping-wiping effect for the cloth to prevent formation of the trickling drop opposing filtration, and the possibility of economically recovering valuable fibers from suspensions heretofore totally discarded.

Accordingly, this technique may be successfully used for the selective purification/filtration in all processes involving granulometric phenomena.

Among these are: the filtration of urban and industrial effluents, the treatment of minerals or foodstuffs, the treatment of paper industry effluents resulting from the fractionating of suspensions of virgin pulps, of waste papers in particular in the de-inking operations.

In the paper industry, the equipment preferably will be placed on the last waste drain immediately before the purification station or at very specific points in the sequence of manufacture.

What is claimed is:

1. Equipment for fractionating solid particles suspended in a liquid, comprising:

a feed conduit for a liquid suspension to be treated; an extraction means for filtrate;

a means for recovering a solid particle concentrated fraction;

a filtering screen comprising an elastically deformable, flexible, perforated sleeve, connected at one end to said feed conduit and at an opposite end to said recovering means;

a means capable of directing the flow of suspension to be treated in a direction parallel to the longitudinal axis of said filtering screen; and a means capable of locally and substantially deforming said sleeve by moving along the generatrix of said sleeve an element disposed outside said sleeve, thereby creating respectively before and after said deformation high and low pressure regions which travel along said sleeve for detaching said particles from said sleeve.

2. Equipment is recited in claim 1, wherein the deforming means is moveable in a direction opposite to the direction of flow of said suspension while deforming said sleeve.

3. Equipment as recited in claim 2, wherein said deforming means comprises a rotating rigid helical coil permanently resting transversely against an outer wall of said sleeve, the direction of translation of a contact point between said coil and said sleeve being opposite the direction of flow of the suspension.

4. Equipment as recited in claim 2, wherein said deforming means is an endless belt moving in a direction opposite that of the flow of the suspension and is provided with a plurality of rigid parallel bars spaced along said belt, and wherein part of said bars rests transversely on an outside wall of said flexible sleeve and deforms said sleeve.

5. Equipment as recited in claim 1, further comprising a plurality of parallel sleeves associated with a single deforming means.

6. Equipment as recited in claim 1, further comprising a plurality of auxiliary suspension feed conduits located within said sleeve downstream of said main feed conduit and essentially directed along the axis of said sleeve.

7. Equipment as recited in claim 1, wherein said equipment is adapted to be oriented and inclined in a vertical plane.

8. Equipment as recited in claim 1, wherein said sleeve is positionally adjustable with respect to said means for deforming said sleeve.

* * * * *